US005673755A

United States Patent [19]

Sundholm

[11] Patent Number: 5,673,755

[45] Date of Patent: Oct. 7, 1997

[54] INSTALLATION FOR FIGHTING FIRE IN A PLURALITY OF FIRE SECTIONS

[76] Inventor: Göran Sundholm, Ilmari Kiannon kuja 3, FIN-04310, Tuusula, Finland

[21] Appl. No.: 454,297

[22] PCT Filed: Dec. 17, 1993

[86] PCT No.: PCT/FI93/00546

§ 371 Date: Sep. 6, 1995

§ 102(e) Date: Sep. 6, 1995

[87] PCT Pub. No.: WO94/14502

PCT Pub. Date: Jul. 7, 1994

[30] Foreign Application Priority Data

Dec. 22, 1992 [FI] Finland ..... 925836

[51] Int. Cl.[6] ..... A62C 35/68

[52] U.S. Cl. ..... 169/16; 169/20; 169/61; 137/597

[58] Field of Search ..... 169/16, 17, 18, 169/19, 20, 60, 61; 137/112, 119.08, 119.09, 597

[56] References Cited

U.S. PATENT DOCUMENTS

| | | | |
|---|---|---|---|
| 3,990,518 | 11/1976 | Hemme | 169/60 |
| 4,082,148 | 4/1978 | Willms | 169/62 |
| 4,305,469 | 12/1981 | Morrisette | 169/61 |

FOREIGN PATENT DOCUMENTS

| | | |
|---|---|---|
| 10465 | 4/1980 | European Pat. Off. . |
| 2804516 | 8/1979 | Germany . |
| 1263262 | 10/1986 | Russian Federation . |
| 1614814 | 12/1990 | Russian Federation . |
| 1754132 | 8/1992 | Russian Federation . |
| 1576203 | 10/1980 | United Kingdom . |

OTHER PUBLICATIONS

Derwent's abstract, No. 93-270751/34, week 9334, Abstract of SU, 1754132 (Fire Fighting Res Inst), 15 Aug. 1992 (15.08.92).

Derwent's abstract, No. 87-155796/22, week 8722, Abstract of SU, 1263262 (Fire-Fighting Cons), 15 Oct. 1986 (15.10.86).

Derwent's abstract, No. 91-337852/46, week 9146, Abstract of SU, 1614814 (Klimenko AS), 23, Dec. 1990 (23.12.90).

*Primary Examiner*—Andrew C. Pike
*Attorney, Agent, or Firm*—Ladas & Parry

[57] ABSTRACT

An installation for fighting fire has a drive unit for extinguishing liquid. A main feed line (5) of the drive unit (1) is connected to a pilot valve having outgoing lines to a plurality of fire sections (A, B, C, D) for opening connection between one of the fire sections (A) and the main feed line (5) and closing of connections from the other fire sections (B, C, D) and the main feed line (5).

10 Claims, 3 Drawing Sheets

INSTALLATION FOR FIGHTING FIRE IN A PLURALITY OF FIRE SECTIONS

The present invention relates to an installation for fighting fire, comprising a drive unit for extinguishing liquid.

In the Finnish patent application 924752 (see international patent publication WO 94/08659); is described an installation for fighting fire having as a drive unit e.g., a plurality of parallel hydraulic accumulators with an initial charge pressure of, e.g., about 200 bar. Such an installation is well suited for fighting fire, e.g., in an engine room of a ship. The engine room is usually divided into a number of separate fire sections or fire zones.

It is desirable to connect the drive unit of the fire fighting installation selectively to that particular fire section where a fire has started. High pressure guide or pilot valves are available for that purpose but they are expensive.

The object of the invention is to provide, for an installation of the kind mentioned above, a new pilot valve means which is of a simple structure and thus is cheap.

The basic idea of the invention is that after an alarm signal has been received, but before actuating the drive unit of the fire fighting installation, the desired flow path is opened through the pilot valve means to connect the drive unit for extinguishing liquid to the respective fire section. Thanks to the invention it is possible to use simple and cheap pilot valves dimensioned for low pressure, or alternatively, small pilot valves intended for high pressure which likewise are cheap.

According to a preferred embodiment of the invention, liquid is in a first step delivered at a relatively low pressure, e.g., about 20 bar, in order to fill the lines leading to the respective fire section with liquid and to cool the respective spray heads and nozzles before actuating the drive unit intended for high pressure liquid spraying, and by utilizing the initial low pressure liquid the connection from the outgoing line of the drive unit is at the same time opened through the pilot valve means to the respective fire section. The outgoing line is still closed at the drive unit during the initial step of combined low pressure spray and opening said connection through the pilot valve means, and thus it is possible to use pilot valves dimensioned for low pressure.

The initial spraying of low pressure liquid as well as establishing the connection from the respective fire section to the main drive unit of the installation can, alternatively, be accomplished by means of, e.g., a hydraulic accumulator which can be charged to either a high pressure or a low pressure. If the accumulator is charged to a high pressure, the connection thereof to the respective outgoing fire section line is arranged through a small high pressure valve which passes a small flow of liquid. Instead of a separate hydraulic accumulator it is also possible to for this purpose use the main drive unit itself which preferably comprises a plurality of hydraulic accumulators coupled in parallel, whereat thus the drive unit at first is connected to the pilot valve means through a small high pressure valve in order to, before commencing the main extinguishing procedure, open such a connection from the respective fire section to the main drive unit that is capable of passing the whole liquid delivery capacity of the drive unit.

By a small high pressure valve, which acts as a pilot valve within the pilot valve means, is here meant a valve having a pass flow aperture diameter of the order, e.g., 2 mm. In comparison, if one were to actuate the drive unit directly at full power, the pilot valve means would require high pressure valves having a pass flow aperture diameter of about 40 mm.

It is essential to perform the establishment of the desired connection in the pilot valve means, intended for the main extinguishing process, by means of a small power, i.e., either by utilizing a low drive pressure, whereat the amount of liquid can be relatively great, although considerably smaller than the main flow during the main extinguishing process, or by utilizing a high pressure and a small amount of liquid.

In the following the invention shall be described in more detail with reference to the attached drawing which, by way of example, shows preferable embodiments of the invention.

Figures 1, 2:
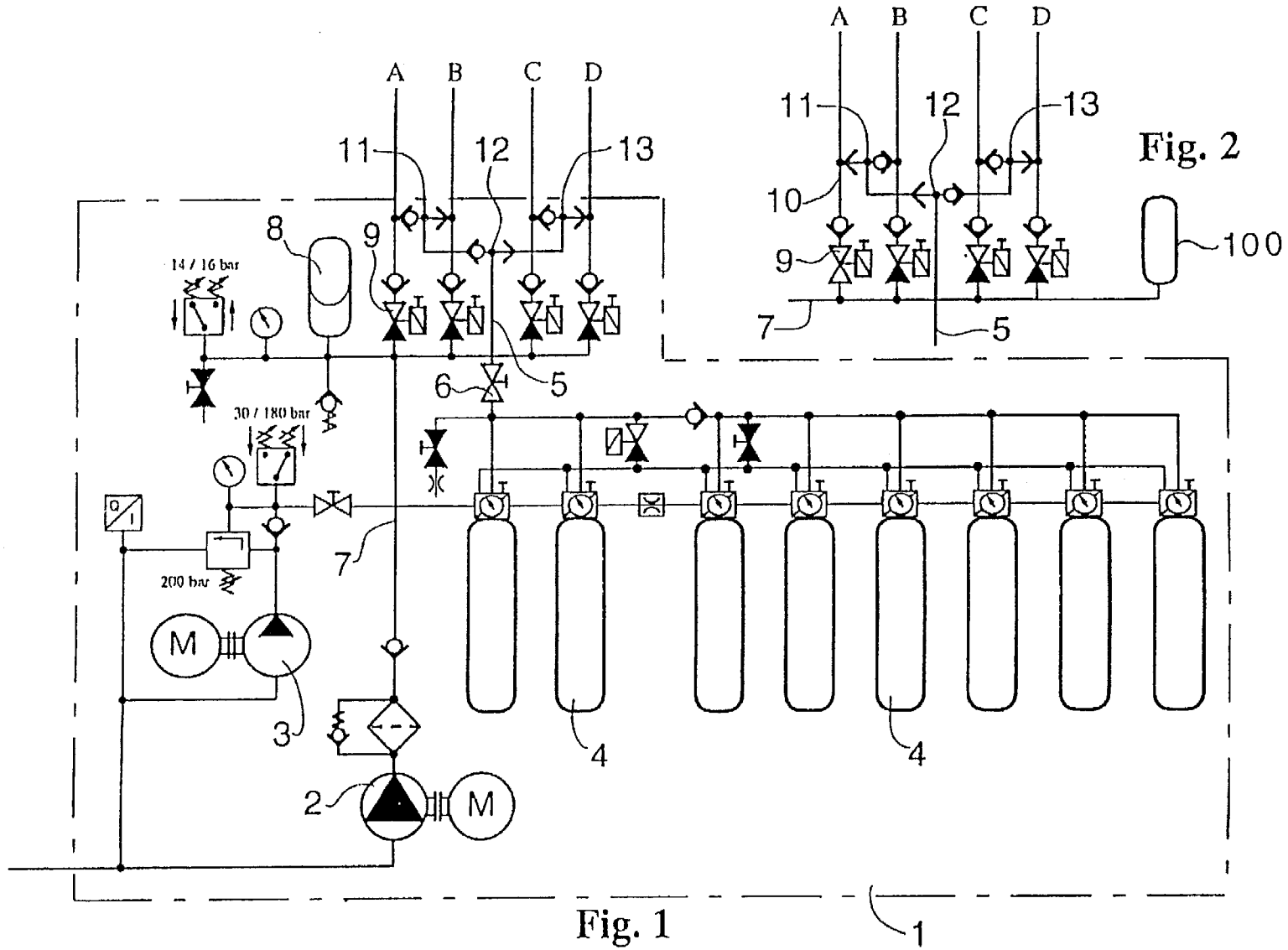
FIG. 1 shows a fire fighting installation in an inactive state.
FIG. 2 illustrates the function of the pilot valve means when a fire has started.

In FIG. 1 a drive unit for delivering high pressure extinguishing liquid in a fire fighting installation is generally indicated by the reference numeral 1. A pilot valve means leads from the drive unit 1 to four fire sections A, B, C and D. A liquid pump with an operating pressure of, e.g., 15 to 20 bar is indicated by 2 and a high pressure liquid pump with an operating pressure of, e.g., 200 bar is indicated by 3. The high pressure pump 3 is arranged to charge a plurality of hydraulic accumulators 4 which preferably are of a structure as described in the Finnish patent application 924752 (see international patent publication WO 94/08659). The outgoing line of the drive unit 1 is indicated by 5 and a shut-off valve in the line 5 is indicated by 6. The valve 6 is usually open, as in FIG. 1.

FIG. 1 shows the installation in an inactive state of standby.

In FIG. 2, a fire has broken out in fire section A. The pump 2 has been activated to deliver liquid through its feed line 7 (alternatively, e.g. in case of electric power fallout, initial pilot liquid can be delivered by a low pressure hydraulic accumulator 8), through the opened valve 9 and a subsequent back valve to the line 10 which leads to spray heads or sprinklers in the fire section A. The pressure in the line 10 moves a first change valve 11, positioned between the feed line to the fire section A and the feed line to the fire section B, from the position shown in FIG. 1 to the position shown in FIG. 2, and a second change valve 12 likewise from the position shown in FIG. 1 to the position shown in FIG. 2. The delivery of low pressure liquid to the fire section A thus opens the connection from the feed line 5 of the high pressure drive unit 1, when the hydraulic accumulators 4 are not yet activated, to the fire section A, while the connections from the feed line 5 of the drive unit 1 to the fire sections B, C, and D are closed.

The high pressure unit 1 can now be activated at will. The valve 9, as well as the corresponding valves to the fire sections B, C, and D, can be of a simple and cheap structure.

FIG. 2 also differs from FIG. 1 in showing a hydraulic high pressure accumulator 100 separate from the drive unit 1 previously described.

Between the feed lines to the fire sections C and D is provided a third change valve 13 which in the present case has not moved. The positions of the change valves 12 and 13 in FIG. 1 indicate that the previous activation, e.g., in order to test the installation, has occurred in the fire section D which in FIG. 1 is in connection to the feed line 5 of the drive unit 1, while the connections to the fire sections A, B, and C are closed.

Figure 3:
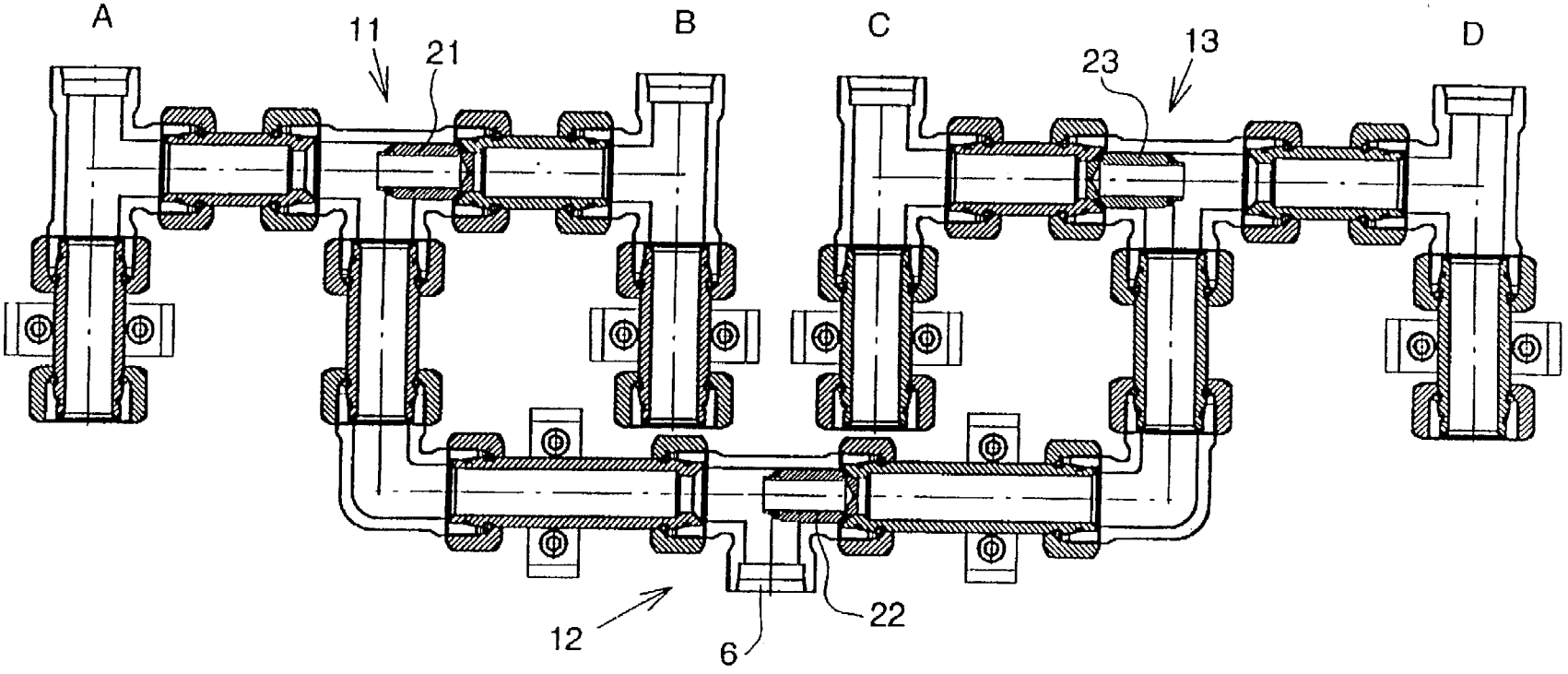
FIG. 3 shows, as a partial longitudinal section, a practical embodiment of a pilot valve means in the state of FIG. 2.

The valve arrangement 11, 12, 13 can be of a simple structure. FIG. 3 shows one embodiment where the change valves 11, 12, and 13 comprise movable sleeves 21, 22, and 23, respectively, with one end closed. If desirable, the pilot valve means can without difficulty be extended to serve a larger number of fire sections, utilizing the same principle.

FIGS. 1–3 show a favorable embodiment of the invention. It is, however, possible to replace the low pressure valves 9 by small high pressure valves 90 (FIG. 2), whereat it for the initial low pressure liquid spraying and simultaneous establishing of the respective connection via the change valves 11, 12, and 13, respectively, is possible to use a hydraulic high pressure accumulator 100 (FIG. 2) which could replace the low pressure hydraulic accumulator 8 and be charged by the high pressure pump 3. The valves 11, 12, and 13 could in principle also be actuated by means of pressurized gas, if it is considered unnecessary to initially cool the nozzles and the spray heads and to fill the feed lines with liquid before the high pressure drive unit 1 is activated.

Alternatively, it is further possible to utilize the hydraulic high pressure accumulators for establishing a connection to a respective fire section. An example is shown in FIG. 4.

From the bottom region of a hydraulic accumulator 4 runs a pipe 30, preferably provided with apertures in its wall, as presented in the Finnish patent application 924752 (see international patent publication WO 94/08659), to a valve structure at the outlet end of the accumulator 4. From the pipe 30 leads a throttled connection 31 in a valve spindle 32, which is forced against the outlet end of the pipe 30 by a spring 33, to a narrow gap 34 between the spindle end of a manually operable valve 35 and the housing of the outlet valve structure. From the passage 34 there is a line 36 to a pilot valve means which in principle is of the same kind as the one shown in FIGS. 1–3. The line 36 corresponds to the line 7 or to the feed line of the hydraulic low pressure accumulator 8 in FIG. 1, while the line 37 in FIG. 4 corresponds to the main feed line 5 in FIG. 1.

Figure 4:
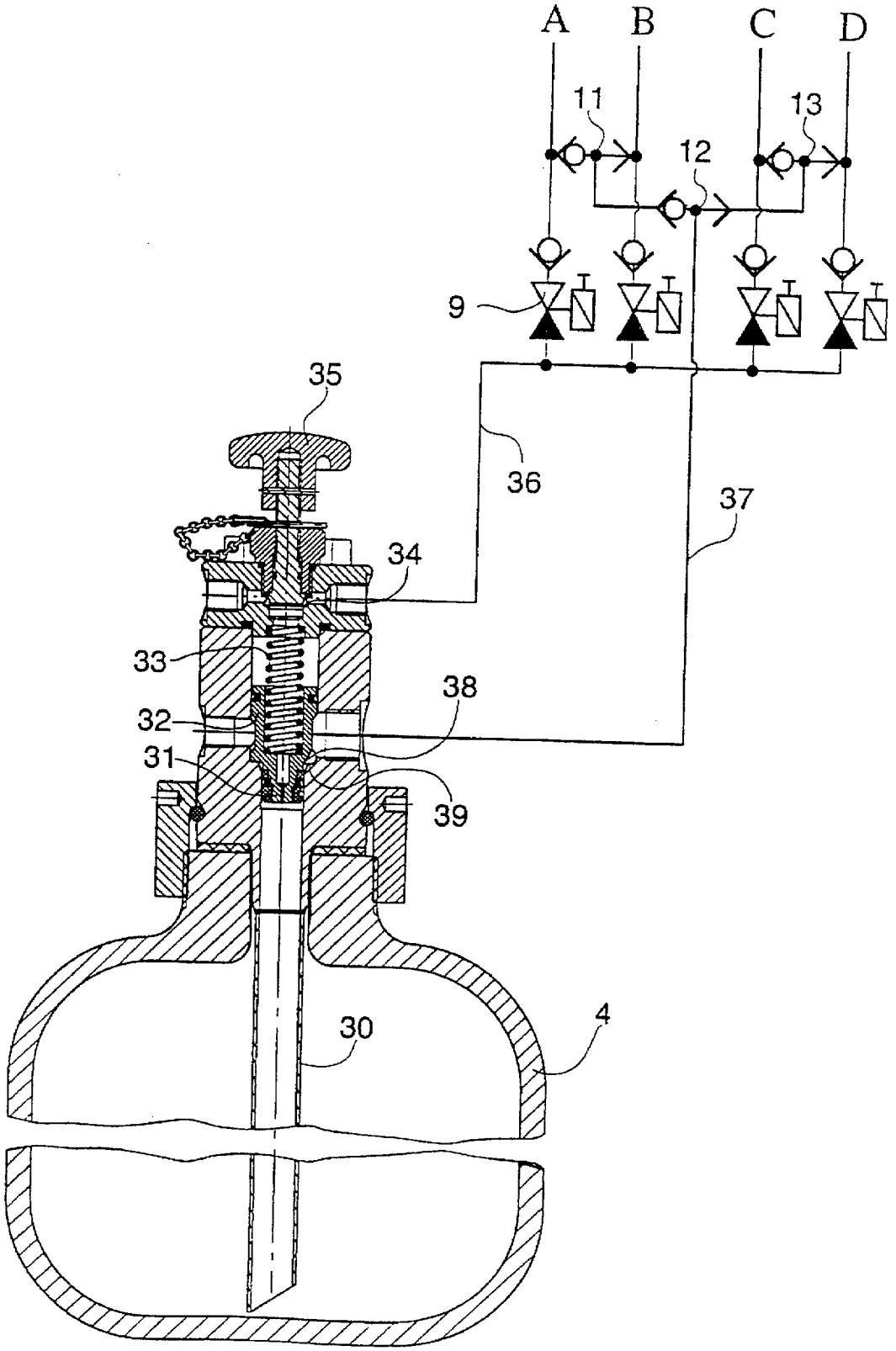
FIG. 4 shows an embodiment utilizing high pressure guiding.

In FIG. 4 the installation is in a state of standby, whereat the pressure in the line 36 is the same as in the accumulator 4, via the connection 31–34. The line 36 can be filled with liquid but there is no liquid flow in the line 36, because the valves 9 to the fire sections A, B, C, and D are all closed.

It shall again be assumed that there is a fire in the fire section A. Alarm results in that the respective valve 9 is opened and liquid flows from the line 36 to the section A and at the same time the valves 11 and 12 are moved to the positions of FIG. 2 in the same way as described earlier, establishing connection from the section A to the line 37. The pressure in the line 37 has access, via a groove 38 or the like formed in the valve spindle 32, to act on a face 39 of the spindle 32, in a direction against the spring 33, whereat the force effected by the pressure on said face 39 together with the force effected by the pressure in the accumulator 4, due to the pressure fall over the throttle 31, drive the valve spindle 32 upwards from the position shown in FIG. 4, so that there is a direct connection from the outlet of the pipe 30 to the line 37, for full delivery of liquid to section A.

The embodiment shown in FIG. 4 can without difficulty be extended to comprise a plurality of hydraulic accumulators 4, e.g., as shown in FIG. 1. This embodiment has an additional advantage in that it is fully workable independently of electric power supply; the valve symbols in FIG. 4 indicate that the valves in first place are intended to be operated automatically, e.g., electrically, with a possibility to be manually operated, as a reserve. With suitable dimensions for the throttles at 31 and 34, the valves 9 in FIG. 4 can be low pressure valves, like in FIGS. 1–3, or alternatively high pressure valves with a small pass flow aperture.

The spray heads, including nozzles, of the installation, in the respective fire sections A, B, C, and D can preferably be of such constructions that are presented, e.g., in the international patent applications PCT/FI92/00060, PCT/FI92/00155, and PCT/FI92/00156, which are WO 92/15370, WO 92/20443 and WO 92/20454, respectively.

Thus, important aspects of the invention are:

An installation for fighting fires comprising a drive unit 1 for extinguishing liquid including a pressure source, a main feed line 5 connected to said pressure source, and a pilot valve means, having outgoing lines to a plurality of fire sections A, B, C, D connectable to said pressure source, for connecting said pressure source to one said outgoing line 10 to one said fire section A for opening a connection 11, 12 between said one fire section A and said main feed line 5 of said drive unit 1 and for closing connections between all other said fire sections B, C, D and said main feed line 5 of said drive unit 1;

an installation wherein said pilot valve means comprises change valves 11, 12, 13 and wherein said outgoing lines are interconnected pairwise A, B,; C, D by at least one of said change valves 11; 13, another one of said change valves 12, further interconnecting said pairwisely interconnected outgoing lines and being directly connected to said main feed line 5;

an installation wherein change elements of said change valves 11, 12, 13 are axially movable sleeves 21, 22, 23;

an installation wherein said pressure source is a liquid source 3; 8 having a low operating pressure in relation to an operating pressure of said drive unit 1;

an installation wherein said liquid source 3; 8 is connected to each said outgoing line 10 through a low pressure valve 9;

an installation wherein said pressure source is a high pressure liquid source connected to each said outgoing line through a small high pressure valve;

an installation wherein said high pressure liquid source is a hydraulic high pressure accumulator 100 separate from said drive unit 1;

an installation wherein said high pressure liquid source is part of said drive unit 1;4;

an installation wherein a throttle 31 passes an initial pilot liquid flow, said throttle 31 being in a spindle 32 of an outlet valve of said high pressure liquid source 4, and wherein a pressure in a main outgoing line 37 of said liquid source 4, after said connection to said one fire section, together with a pressure fall across said throttle 31, drives said spindle 32 to open direct connection from said liquid source to said main outgoing line 37 of said liquid source 4; and an installation wherein said pressure in said main outgoing line 37 of said liquid source 4 acts through a groove 38 on a face 39 provided on said spindle 32.

I claim:

1. Installation for fighting fires comprising a drive unit (1) for extinguishing liquid including:

a pressure source, a main feed line (5) connected to said pressure source, and a pilot valve means, having outgoing lines to a plurality of fire sections (A, B, C, D) connectable to said pressure source, for connecting said pressure source to one said outgoing line (10) to one said fire section (A) for opening a connection (11, 12) between said one fire section (A) and said main feed line (5) of said drive unit (1) and for closing connections between all other said fire sections (B, C, D) and said main feed line (5) of said drive unit (1).

2. Installation according to claim 1, wherein said pilot valve means comprises change valves (11, 12, 13) and wherein said outgoing lines are interconnected pairwise (A, B; C, D) by at least one of said change valves (11; 13), another one of said change valves (12) further interconnecting said pairwisely interconnected outgoing lines and being directly connected to said main feed line (5).

3. Installation according to claim 2, wherein change elements of said change valves (11, 12, 13) are axially movable sleeves (21, 22, 23).

4. Installation according to claim 1, wherein said pressure source is a liquid source (3; 8) having a low operating pressure in relation to an operating pressure of said drive unit (1).

5. Installation according to claim 4, wherein said liquid source (3; 8) is connected to each said outgoing line (10) through a low pressure valve (9).

6. Installation according to claim 1, wherein said pressure source is a high pressure liquid source connected to each said outgoing line through a small high pressure valve.

7. Installation according to claim 6, wherein said high pressure liquid source is a hydraulic high pressure accumulator (100) separate from said drive unit (1).

8. Installation according to claim 6, wherein said high pressure liquid source is part of said drive unit (1; 4).

9. Installation according to claim 8, wherein a throttle (31) passes an initial pilot liquid flow, said throttle (31) being in a spindle (32) of an outlet valve of said high pressure liquid source (4), and wherein a pressure in a main outgoing line (37) of said liquid source (4), after said connection to said one fire section, together with a pressure fall across said throttle (31), drives said spindle (32) to open direct connection from said liquid source to said main outgoing line (37) of said liquid source (4).

10. Installation according to claim 9, wherein said pressure in said main outgoing line (37) of said liquid source (4) acts through a groove (38) on a face (39) provided on said spindle (32).

* * * * *